US011629563B2

(12) United States Patent
Lock

(10) Patent No.: US 11,629,563 B2
(45) Date of Patent: Apr. 18, 2023

(54) METHOD AND APPARATUS FOR MAINTAINING BOTTOM HOLE PRESSURE DURING CONNECTIONS

(71) Applicant: Beyond Energy Services & Technology Corp., Calgary (CA)

(72) Inventor: Jason Lock, Grande Prairie (CA)

(73) Assignee: Beyond Energy Services & Technology Corp., Calgary (CA)

( * ) Notice: Subject to any disclaimer, the term of this patent is extended or adjusted under 35 U.S.C. 154(b) by 0 days.

(21) Appl. No.: 15/754,727

(22) PCT Filed: Jun. 15, 2017

(86) PCT No.: PCT/CA2017/000146
§ 371 (c)(1),
(2) Date: Feb. 23, 2018

(87) PCT Pub. No.: WO2018/000076
PCT Pub. Date: Jan. 4, 2018

(65) Prior Publication Data

US 2019/0352985 A1 Nov. 21, 2019

(30) Foreign Application Priority Data

Jun. 23, 2016 (CA) ..... 2933855

(51) Int. Cl.
*E21B 21/08* (2006.01)
*E21B 19/16* (2006.01)
*E21B 21/14* (2006.01)

(52) U.S. Cl.
CPC ..... *E21B 21/08* (2013.01); *E21B 19/16* (2013.01); *E21B 21/14* (2013.01)

(58) Field of Classification Search
CPC ..... E21B 21/08; E21B 19/16; E21B 21/14
See application file for complete search history.

(56) References Cited

U.S. PATENT DOCUMENTS 3,693,732 A 9/1972 Sabi
6,374,925 B1 * 4/2002 Elkins ..... E21B 19/16 175/25

(Continued)

OTHER PUBLICATIONS

International Search Report and Written Opinion dated Sep. 11, 2017 filed in International Application No. PCT/CA2017/000146.

*Primary Examiner* — D. Andrews
(74) *Attorney, Agent, or Firm* — Berg Hill Greenleaf Ruscitti LLP

(57) ABSTRACT

A system for use in the drilling of oil or gas wells in conjunction with a mud injection device, said mud injection device adapted to maintain fluid pressure control within the borehole of a well bore when operating a drillstring therethrough, the system comprising: a gas reservoir containing gas; adapted for injection to control borehole pressure; compression system fluidly connected to the gas reservoir and the borehole; a pressure regulation system operatively connected to the gas reservoir and the borehole and adapted to measure the pressure within the annulus and relay such to a computer; wherein, when a drilling operation is halted to add a new stand to the drillstring and the mud injection device is stopped, the gas is injected to maintain the borehole pressure within the annulus of the borehole at a near constant value.

3 Claims, 4 Drawing Sheets

(56) References Cited

U.S. PATENT DOCUMENTS

| | | | |
|---|---|---|---|
| 7,281,593 | B2 | 10/2007 | Steiner et al. |
| 8,403,034 | B2 | 3/2013 | Askeland et al. |
| 8,955,619 | B2 | 2/2015 | Tilton et al. |
| 9,249,638 | B2 | 2/2016 | Bernard |

* cited by examiner

METHOD AND APPARATUS FOR MAINTAINING BOTTOM HOLE PRESSURE DURING CONNECTIONS

CROSS REFERENCE TO RELATED APPLICATIONS

This application is a national stage application under 35 U.S.C. 371 and claims the benefit of PCT Application No. PCT/CA2017/000146 having an international filing date of Jun. 15, 2017, which designated the United States, which PCT application claimed the benefit of Canadian Patent Application No. 2,933,855, filed Jun. 26, 2016, the disclosure of each of which are incorporated herein by reference.

FIELD OF THE INVENTION

An apparatus and method for maintaining bottom hole pressure to a near-constant value during connections and/or maintain a constant surface back pressure. The method and associated equipment address a particular problem in managed pressure drilling (MPD): maintaining a constant bottom hole pressure during pumps off.

BACKGROUND OF THE INVENTION

When drilling for oil and gas, one encounters geological formations that have a narrower tolerance for changes in bottom hole pressure. A widely adopted solution to this problem is the so called 'Managed Pressure Drilling' (MPD). In this variant of drilling, the annular space is closed to the atmosphere by means of a Rotating Control Device (RCD). A RCD is a pressure-control device used during drilling for the purpose of making a seal around the drillstring during its rotation. The RCD is designed to contain hydrocarbons or other wellbore fluids and prevent their release to the atmosphere. The RCD diverts the fluid into a manifold armed with a specialized choke that allows manipulation of the well's bottom hole pressure. Right before breaking connection to add a new stand, the pumps are ramped down. At the same time, the dynamic component of the bottom hole pressure drops and needs to be compensated for, in order to maintain a near-constant bottom hole pressure.

In the oil and gas industry, it is paramount to ensure the safety of employees, a problem that may jeopardize employees' safety on a drilling rig is known as a "blowout". When a zone of high geopressure is encountered during a drilling operation and the pressure exceeds the hydrostatic pressure exerted by the drilling mud, and the formation has sufficient permeability to allow fluid flow, then the formation fluid will move into the wellbore and displace the drilling mud. This is referred to as a "kick"; and if unchecked it will result in a "blowout" which is an uncontrolled release of crude oil and/or natural gas from an oil well or gas well after pressure control systems have failed.

Standard practice provides a choke in a manifold connecting with the annulus of the well beneath a blow-out preventer to allow the choke to establish and maintain a back pressure on the drilling mud diverted through the manifold when the BOP is shut off. The back pressure, along with the hydrostatic pressure of the drilling mud contained within the well, allow the containment of the pressured fluids within the formations penetrated by the wellbore. The aforementioned choke is preferably adjustable so that, in the case of an excess of pressure from the formation fluid also referred to as a kick it can be regulated in order to maintain a predetermined pressure differential between the bottom hole pressure of the drilling mud and the pressure generated by the formation fluid. It is critical to be able to contain the down hole fluid as well as avoid excessive back pressure which might cause damage to the drill string, casing or formation.

As mentioned above, devices used in the art comprised of backpressure pumps connected to a choke which allow the pumping of drilling mud down the borehole to maintain the bottom hole pressure constant during the adding of a stand to the drillstring. This allows a stand to be added but requires extreme vigilance as an excess of mud can cause a sudden increase in bottom hole pressure and cause fracking of the formation. This, in turn, increases the pressure downhole and creates open zones along the wellbore. Alternatively, if not enough pressure is used then there is a high likelihood of the well to kick which will require a well kill via the rigs manifold and causes a well shut down of several hours. Well shut downs can cause losses of revenue of up to $10,000 per hour. A breakdown in the equipment or malfunctioning software for a few seconds can lead to an increase in pressure which ends up in the aforementioned undesired fracking situation.

U.S. Pat. No. 3,552,502 A teaches a method and apparatus for controlling oil and gas wells wherein there is no dependency upon stopping the circulating pump, and shutting in the well. It is said that this is accomplished by providing means for monitoring drill pipe pressure, mud volume and mud weight being pumped into the hole, and controlling an adjustable choke with such information. The system calculates the necessary mud weight to kill the well and controls the adjustable choke during the entire pumping time required to kill the well and to maintain allows continued circulation of the drilling fluid while calculating shut-in drill pipe pressure and calculating mud weight.

CA 2 477 242 and CA 2 516 277 teach a closed loop, overbalanced drilling system having a variable overbalance pressure capability. It is said to utilize information related to the wellbore, drill rig and drilling fluid as inputs to a model to predict downhole pressure. The predicted downhole pressure is then compared to a desired downhole pressure and the differential is utilized to control a backpressure system. It is also said that the use of backpressure to increase annular pressure is more responsive to sudden changes in formation pore pressure.

CA 2 667 199 teaches a method for maintaining pressure in a wellbore during drilling operations. The method is said to include the steps of providing fluid from a reservoir through a drill string, circulating the fluid from the drill string to an annulus between the drill string and the wellbore, isolating pressure in the annulus, measuring pressure in the annulus, calculating a set point backpressure, applying back pressure to the annulus based on the set point back pressure, diverting fluid from the annulus to a controllable choke, controllably bleeding off pressurized fluid from the annulus, separating solids from the fluid, and directing the fluid back to the reservoir.

Despite the existing prior art, there still exists a need for a robust, reliable system to maintain downhole pressure in a borehole which does not rely on a back pressure pump and injection of mud during the addition or removal of a stand on a drillstring. The present invention proposes the injection of a compressible gas to maintain the borehole pressure during operations involving the removal or addition of a stand to a drillstring.

Nitrogen is an inert gas used for a variety of functions in the oil and gas industry. In onshore as well as offshore situations, the applications for nitrogen include well stimulation, injection and pressure testing, Enhanced Oil Recovery (EOR), reservoir pressure maintenance, nitrogen floods and inert gas lift. Additionally, nitrogen can be used to help prevent flammable gases from igniting and protect tubulars from downhole corrosion. Used to support drilling operations, nitrogen finds various uses including flare gas inerting, and pressure systems purging and testing. Nitrogen can also be supplied for the engine starters, controls, dry bulk transfer and hoisting systems. Providing a dry air supply, nitrogen can help in extending the useful working life of some systems, as well as prevent their breakdowns. In workover and completion operations, nitrogen allows for the displacement of well fluids in order to initiate flow and clean wells because of its low density and high pressure characteristics. Moreover, nitrogen is found to be useful to maintain pressure in reservoirs that have either been depleted of hydrocarbons or experienced natural pressure reduction. Because it is immiscible with oil and water, a nitrogen injection program or nitrogen flood can be used to move pockets of hydrocarbons from an injection well to a production well.

SUMMARY OF THE INVENTION

According to a first aspect of the present invention, there is provided a method to provide backpressure to a well during an operation involving the addition of a stand, said method comprising the injection of a compressible gas down the borehole to maintain the bottom hole pressure near-constant during the addition of the stand.

According to a preferred embodiment of the present invention, the method comprises the addition of a gas selected from the group consisting of: carbon dioxide, air and nitrogen. Preferably, the gas is nitrogen.

When the drilling rig is ready to do a connection, a ramp-schedule (SCH) is computed by an engineer prior to this connection. The ramp-schedule includes all the parameters required by an operator in order to maintain a near-constant bottomhole pressure during a managed pressure drilling connection.

According to a preferred embodiment of the present invention, the method comprises the steps of:

- ramping down RPM and adjusting MPD choke following a ramp schedule;
- ramping down pumps and adjusting MPD choke following the ramp schedule;
- simultaneously, activating the gas compressor to inject nitrogen from the reservoir and following a ramp-schedule to maintain the borehole pressure close to a constant value.

Pressuring up/down the bottom hole pressure is an orchestrated operation between the rig pumps, MPD choke, surface RPM and the gas compressor. At this point, the surface back pressure (SBP) is at target value and the rig is ready to break connection and add a new stand. Once the new stand is connected, the steps in the ramp schedule are performed in the reverse order. This means ramping up the rig pumps, RPM, while adjusting the MPD choke and bleeding down the gas compressor apparatus in an orchestrated fashion.

According to another aspect of the present invention, there is provided a method to maintain fluid pressure control to a well bore during an operation involving the addition or removal of a stand to a drill-string, said method comprising the injection of a compressible gas to maintain the bottom hole pressure near-constant during the operation. Preferably, the compressible gas is selected from the group consisting of: carbon dioxide, air and nitrogen. More preferably, the compressible gas is nitrogen.

According to a preferred embodiment of the present invention, the method further comprises a ramp-schedule comprising a number of parameters obtained from a pressure monitoring system, said parameters required by an operator to maintain a near-constant bottom hole pressure during a managed pressure drilling connection. Preferably, the parameters comprise at least one of the following: drilling fluid weight, primary pump pressures, drilling fluid flow rates, drill string rate of penetration, drill string rotation rate, surface applied backpressure and sensor data transmitted by said bottom hole assembly.

Preferably also, the method can comprise the steps of:

a) ramping down a pump injecting drilling mud down the borehole and adjusting the managed pressure drilling choke following a ramp schedule; and b) simultaneously, injecting said gas and following said ramp-schedule.

According to another aspect of the present invention, there is provided a system for use in the drilling of oil or gas wells in conjunction with a mud injection device, said mud injection device adapted to maintain fluid pressure control within the borehole of a well bore when operating a drill-string therethrough, the system comprising:

- a gas reservoir containing gas adapted for injection to control borehole pressure;
- a compression system fluidly connected to the gas reservoir and the borehole;
- a pressure regulation system operatively connected to the gas reservoir and the borehole and adapted to measure the pressure within the annulus wherein, when a drilling operation is halted to add a new stand to the drillstring and the mud injection device is stopped, the gas is injected to maintain the borehole pressure within the annulus of the borehole at a near constant value.

Preferably, the system further comprises a gas injector fluidly connected to the gas reservoir and the borehole.

According to yet another aspect of the present invention, there is provided a system for use in the drilling of oil or gas wells adapted to purge lines when a drilling rig is operating a drillstring, the system comprising:

- a gas reservoir containing gas adapted for injection to purge lines of gas released from a borehole where the drillstring is inserted;
- a compression system fluidly connected to the gas reservoir, the lines and the borehole;
- a pressure regulation system operatively connected to the gas reservoir and the borehole and adapted to measure the pressure within the annulus of the borehole;

wherein, at any given time during a drilling operation gas can be injected through the lines to purge the latter of formation released gases.

BRIEF DESCRIPTION OF THE FIGURES

The invention may be more completely understood in consideration of the following description of various embodiments of the invention in connection with the accompanying figure, in which.

DESCRIPTION OF A PREFERRED EMBODIMENT

Figure 1:
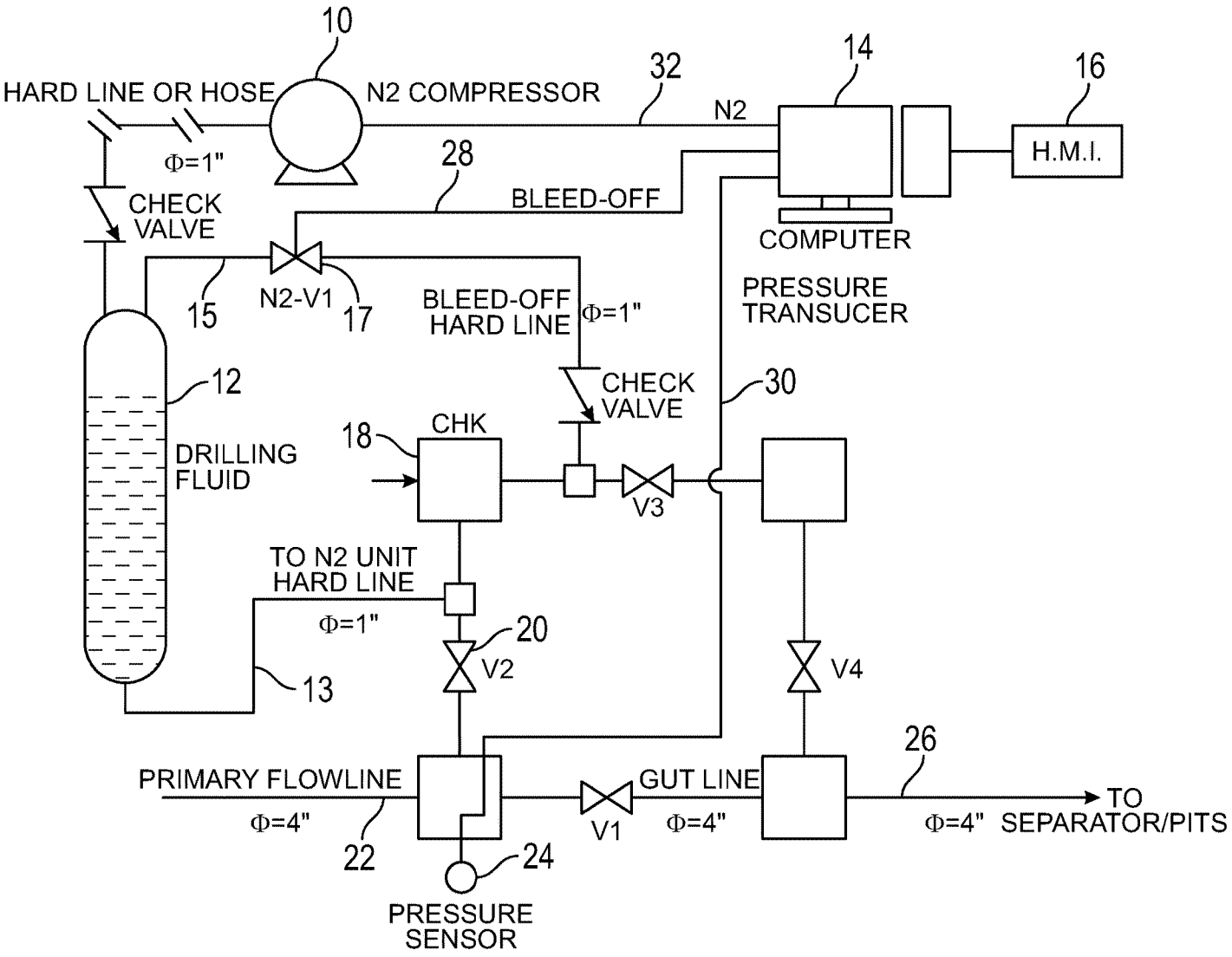
FIG. 1 is a schematic of a drilling set-up incorporating the device according to a preferred embodiment of the present invention.

According to a preferred embodiment, FIG. 1 depicts a schematic layout of a system for use in the drilling of oil or gas wells in conjunction with a mud injection device, said mud injection device adapted to maintain fluid pressure control within the borehole of a well bore when operating a drill string therethrough, the system comprising:

- a compression system fluidly connected to the gas reservoir and the borehole;
- a gas reservoir containing gas adapted for injection to control borehole pressure;
- a pressure regulation system operatively connected to the gas reservoir and the borehole and adapted to measure the pressure within the annulus and relay such to a computer;

wherein, when a drilling operation is halted to add a new stand to the drillstring and the mud injection device is stopped, the gas is injected to maintain the borehole pressure within the annulus of the borehole at a near constant value.

According to a preferred embodiment of the present invention, there is provided an apparatus involve the following elements:

a) Nitrogen reservoir equipped with a compression system. Commercially available units having the technical to fulfill the requirements of the method according to a preferred embodiment of the present invention are readily available.

b) Remotely operated pressure regulation system. According to a preferred embodiment, this can be a simple combination of electrical actuators and pressure regulators.

c) Drilling fluid tank, rated at the same operating pressure as the primary flowline. This tank serves as a reservoir that prevents the addition of nitrogen pumped into the active fluid system.

According to a preferred embodiment of the present invention, the system, as described previously and schematically depicted in FIG. 1, is capable of:

1. operating in a time frame suitable for a drilling connection;
2. operating safely in a Zone 1 environment. This applies to all components of this apparatus: nitrogen tanks and compression, sensors/transducers, PLC or data processing computer, electrical cables, hydraulic actuators and fittings; and
3. automating the process of manipulating the pressure in the primary flowline by means of: surface data acquisition; signal processing; operator input; pressure regulators; and remotely operated actuators.

FIG. 1 shows a drilling set-up incorporating the device according to a preferred embodiment of the present invention. There is a gas reservoir (not shown) equipped with a gas compressor (10) connected to a computer (14) via connection (32). A user may operate the computer via a human-machine interface (16). The computer (14) monitors the pressure from inside the wellbore with the use of a pressure sensor (24) connected to the computer via wire (30) and controls the volume of gas injected into the wellbore. There is a drilling fluid reservoir (12) connected via drilling fluid line (13) to a choke (18) and a valve (20) connecting the drilling fluid to the primary flow line (22). Reservoir (12) further comprises a line (15) leading to the choke. The line (15) is equipped with a valve (17) to allow bleeding off of the line. This operation is determined and implemented by the computer through an activation through line (28). Line (26) leads the fluid to a separator (not shown). When a drillstring is stopped to add a stand, the drilling mud injection is halted and the gas compressor (10) is put in operation to maintain the pressure within the wellbore to within an acceptable range. The compressibility of the gas used allows to absorb "kicks" and prevent blowouts without having to work within a very tight window of pressure comparatively to conventional systems described hereinabove. A second advantage of the system depicted is that it prevents the unwanted fracking of formations again because of the compressibility of the gas used. This has substantial advantages in comparison to conventional systems all the while providing a valuable safety element during the addition/removal of a stand.

Figure 2:
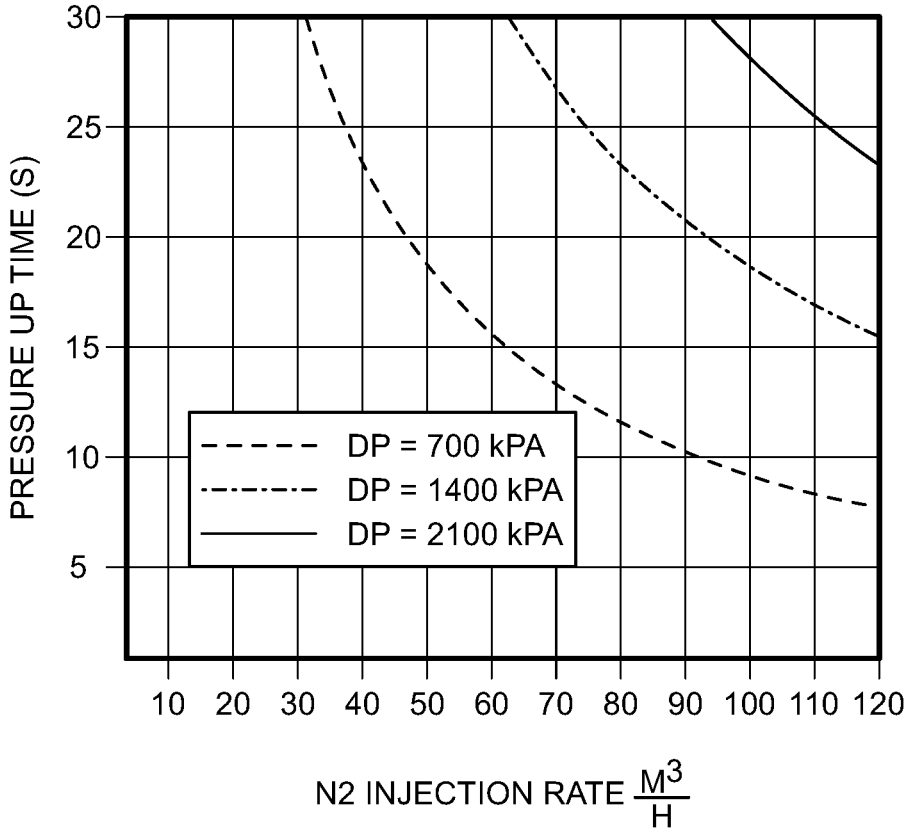
FIG. 2 is a graph representing the process-time estimates for the apparatus and method, based on classical thermodynamics.

FIG. 2 is a graphical depiction representing the process-time estimates for the apparatus according to the present invention as well as the method using said apparatus, based on classical thermodynamics. It depicts the correlation between the rate of injection of the gas used (nitrogen) and the time (in seconds) to pressure up.

Figure 3:
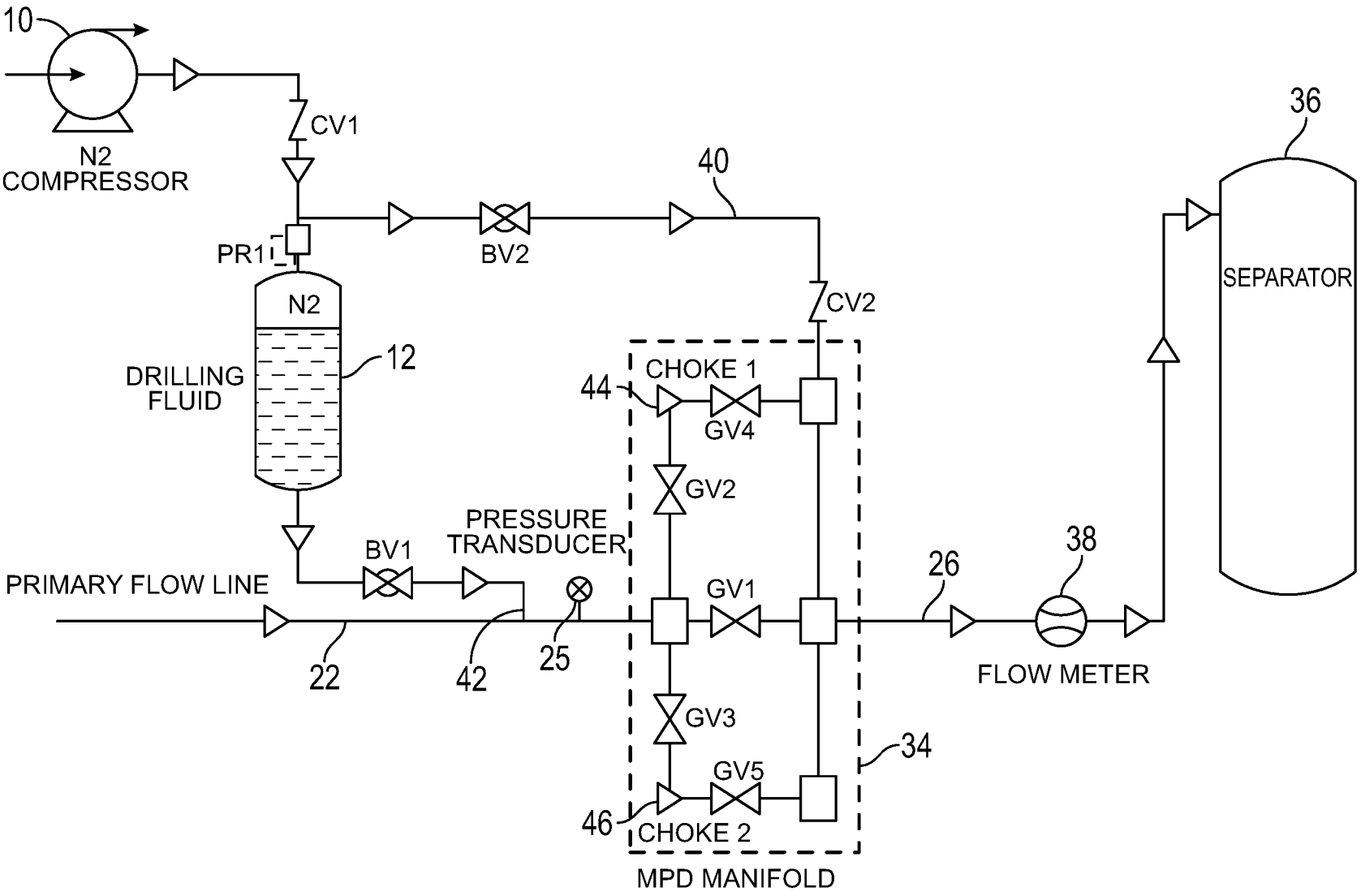
FIG. 3 is a schematic of a drilling set-up incorporating the device according to a preferred embodiment of the present invention.

FIG. 3 illustrates an alternative preferred embodiment where the gas compressor (10) is fluidly connected to the drilling fluid reservoir (12) and the nitrogen can be pumped directly into the flowline upstream (40) of the MPD manifold (34) and/or inside the drilling fluid reservoir (12). A pressure transducer is located on the primary flow line (22) after the drilling fluid injection point (42). Beyond the pressure transducer is located the managed pressure drilling unit (MPD manifold) (34) comprising various valves and chokes (including Choke 1 (44) and Choke 2 (46)). Both of chokes 1 and 2 (44 and 46) are fluidly connected the gas compressor (10) and the primary flow line (22). To the left of the MPD manifold (34) is the flow line (26) leading to a separator (36). There is preferably a flow meter (38) located along the line to provide information to the user as to the rate of flow of the fluid going to the separator. A number of valves are located throughout the set-up both within the MPD and along various lines in order to provide operational flexibility in maintaining and/or optimizing the various fluids' pressures and flows.

Figure 4:
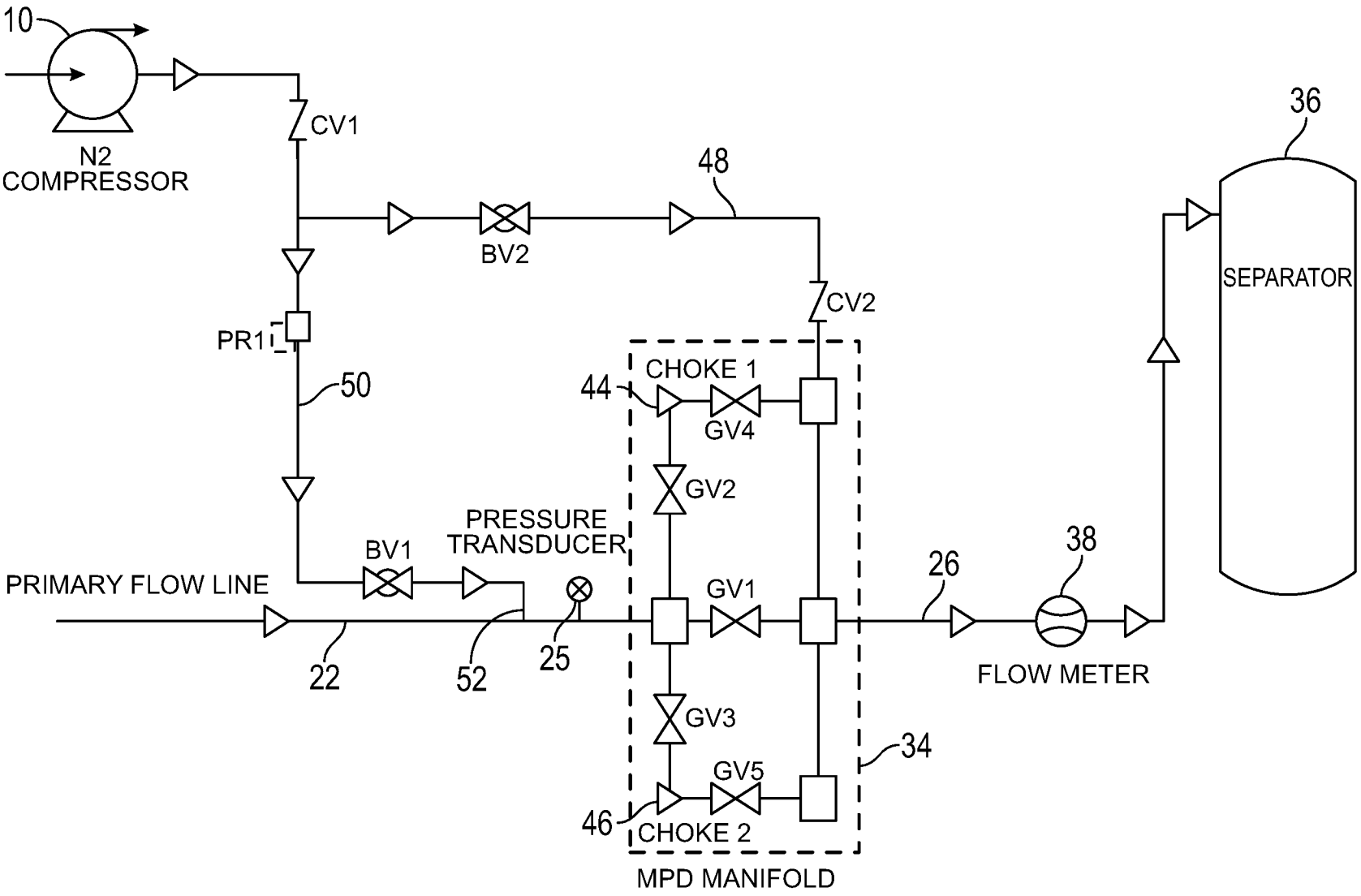
FIG. 4 is a schematic of a drilling set-up incorporating the device according to a preferred embodiment of the present invention.

FIG. 4 illustrates yet another alternative preferred embodiment where the drilling fluid tank is removed and the nitrogen is pumped directly from the gas compressor (10) into the flowline (48) upstream of the choke manifold or into a line (50) leading directly to the primary flowline (22) prior to the latter connection to the MPD manifold. There is a pressure transducer (25) located on the primary flow line (22) after the compressed gas injection point (52). Beyond the pressure transducer is located the managed pressure drilling unit (MPD manifold) (34) comprising various valves and chokes (including Choke 1 (44) and Choke 2 (46)). Both of chokes 1 and 2 (44 and 46) are fluidly connected the gas compressor (10) and the primary flow line (22). To the left of the MPD manifold (34) is the flow line (26) leading to a separator (36). There is preferably a flow meter (38) located along the line to provide information to the user as to the rate of flow of the fluid going to the separator. In this embodiment, the gas compressor is linked directly to the primary flow line in the absence of a drilling fluid reservoir.

The embodiments described herein are to be understood to be exemplary and numerous modification and variations of the present invention are possible in light of the above teachings. It is therefore to be understood that within the scope of the claims appended hereto, the invention may be practiced otherwise than as specifically disclosed herein.

The invention claimed is:

1. A method to maintain a bottom hole fluid pressure control to a wellbore of a drilling rig that utilizes a drillstring and to facilitate adding a new drill stand, said method comprising:

providing a gas reservoir equipped with a gas compressor connected to a computer via a connection wherein a user operates the computer via a human-machine interface and wherein the computer monitors pressure inside the wellbore with the use of a pressure sensor and further wherein the computer controls a volume of gas injected into the wellbore;

providing a drilling fluid reservoir connected via a drilling fluid line to a managed pressure drilling choke and a valve connecting the drilling fluid to a primary flow line;

injecting drilling mud in the wellbore by a mud injection device adapted to maintain fluid pressure control;

providing a managed pressure drilling manifold with a flowline connected to said gas compressor;

conducting drilling by the drilling rig;

executing a ramp-schedule computation;

halting drilling to add a new stand to the drillstring, wherein the mud injection device is stopped;

injecting the compressible gas directly into the managed pressure drilling manifold from said flowline to maintain borehole pressure within the annulus of the wellbore at the desired constant pressure;

in response to said executing step, ramping down pumping of the drilling mud by ramping down revolutions per minute (RPM) of the mud injection device and adjusting the managed pressure drilling (MPD) choke following the execution of the ramp-schedule computation;

wherein injecting the compressible gas into the wellbore occurs following execution of the ramp-schedule to maintain the borehole pressure;

wherein the gas compressor is activated simultaneously to inject gas from the gas reservoir following execution of the ramp-schedule;

breaking connection of the drill rig to add a new drill stand and then adding the new drill stand to the drill rig;

ramping up RPM of the mud injection device while adjusting the MPD choke and bleeding down the gas compressor;

executing the ramp-schedule computation comprising parameters obtained from a pressure monitoring system, said parameters enabling an operator to maintain a constant desired bottom hole pressure during a managed pressure drilling connection; and wherein the parameters comprise consideration of at least one of: drilling fluid weight, drilling fluid flow rates, drill string rates of penetration and drill string rotation rate.

2. The method according to claim 1 wherein the compressible gas is selected from the group consisting of: carbon dioxide, air and nitrogen.

3. The method according to claim 1 wherein the compressible gas is nitrogen.

* * * * *